US008376578B2

(12) United States Patent
Kong et al.

(10) Patent No.: US 8,376,578 B2
(45) Date of Patent: Feb. 19, 2013

(54) LIGHTING DEVICE

(75) Inventors: Kyung Il Kong, Seoul (KR); Hwa Young Kim, Yongin-si (KR)

(73) Assignee: LG Innotek Co., Ltd., Seoul (KR)

( * ) Notice: Subject to any disclaimer, the term of this patent is extended or adjusted under 35 U.S.C. 154(b) by 458 days.

(21) Appl. No.: 12/652,691

(22) Filed: Jan. 5, 2010

(65) Prior Publication Data

US 2010/0327768 A1 Dec. 30, 2010

(30) Foreign Application Priority Data

Jun. 12, 2009 (KR) ..... 10-2009-0052161
Jun. 29, 2009 (KR) ..... 10-2009-0058160
Jun. 29, 2009 (KR) ..... 10-2009-0058162

(51) Int. Cl.
*F21V 1/00* (2006.01)

(52) U.S. Cl. ..... 362/249.02; 362/297; 362/296.08; 362/347; 362/241

(58) Field of Classification Search ..... 362/249.01–249.06, 240, 241, 362/297, 147, 217.1–217.17, 404, 408, 431, 362/368, 235, 296.01, 347, 296.08
See application file for complete search history.

(56) References Cited

U.S. PATENT DOCUMENTS 6,238,073 B1 * 5/2001 Ito et al. ..... 362/544
7,976,187 B2 * 7/2011 Villard ..... 362/246
8,052,295 B2 * 11/2011 Kim et al. ..... 362/97.3
2005/0068787 A1 3/2005 Ishida
2006/0268555 A1 11/2006 Kelly
2009/0002997 A1 1/2009 Koester
2010/0296266 A1 11/2010 Dussault et al.

FOREIGN PATENT DOCUMENTS

EP 1847762 A2 10/2007
FR 2 860 280 A1 1/2005
JP 6-283004 A 10/1994
JP 11-273430 A 10/1999
KR 10-2006-0036039 A 4/2006
KR 10-2006-0053757 A 5/2006
KR 20-0425942 Y1 9/2006
KR 10-2008-0033328 A 4/2008
KR 10-2009-0010016 A 1/2009
KR 10-2009-0054678 A 6/2009
WO WO 2005/055328 A1 6/2005
WO WO 2005/078338 A1 8/2005
WO WO 2009/033478 A1 3/2009

* cited by examiner

*Primary Examiner* — Bao Q Truong
(74) *Attorney, Agent, or Firm* — Birch, Stewart, Kolasch & Birch, LLP

(57) ABSTRACT

A lighting device including a reflector including a reflecting surface, and a light source unit disposed under the reflector and configured to emit light towards the reflector. Further, the light source unit includes a main body disposed longitudinally along the reflector and having first and second outside surfaces that are inclined towards the reflecting surface, and a plurality of first light emitting diodes disposed on the first outside surface and a plurality of second light emitting diodes disposed on the second outside surface and configured to emit the light towards the reflector.

19 Claims, 9 Drawing Sheets

LIGHTING DEVICE

The present application claims priority under 35 U.S.C. 119 and 35 U.S.C. 365 to Korean Patent Application Nos. 10-2009-0058160, 10-2009-0058161 and 10-2009-0058162, all filed on Jun. 29, 2009, and which are hereby incorporated by reference in their entirety.

BACKGROUND OF THE INVENTION

1. Field of the Invention

The present disclosure relates to a lighting device including light emitting diodes (LEDs).

2. Discussion of the Background

Most lighting in homes, offices, parks, etc. is provided via fluorescent and incandescent lamps. However, these types of light sources are not environmentally friendly, tend to have limited or short life spans and have high power consumption. Thus, the costs of operating and maintaining these related art types of lighting sources are significant, especially when considering many light sources are turned on at a single instance.

SUMMARY OF THE INVENTION

Accordingly, one object of the present invention is to address the above-noted and other problems.

Another object of the present invention is to provide a novel lighting device including a plurality of light emitting diodes that provide a low power consumption, a long service life, a rapid response speed, a stable light source and environmentally-friendly properties.

Yet another object of the present invention is to provide a novel lighting device that is easy to disassemble.

To achieve these and other advantages and in accordance with the purpose of the present invention, as embodied and broadly described herein, the present invention provides in one aspect a lighting device including a reflector including a reflecting surface, and a light source unit disposed under the reflector and configured to emit light towards the reflector. Further, the light source unit includes a main body disposed longitudinally along the reflector and having first and second outside surfaces that are inclined towards the reflecting surface, and a plurality of first light emitting diodes disposed on the first outside surface and a plurality of second light emitting diodes disposed on the second outside surface and configured to emit the light towards the reflector.

Further scope of applicability of the present invention will become apparent from the detailed description given hereinafter. However, it should be understood that the detailed description and specific examples, while indicating preferred embodiments of the invention, are given by illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings, which are given by illustration only, and thus are not imitative of the present invention, and wherein.

DETAILED DESCRIPTION OF THE EMBODIMENTS

Reference will now be made in detail to the preferred embodiments of the present invention, examples of which are illustrated in the accompanying drawings.

Figure 1:
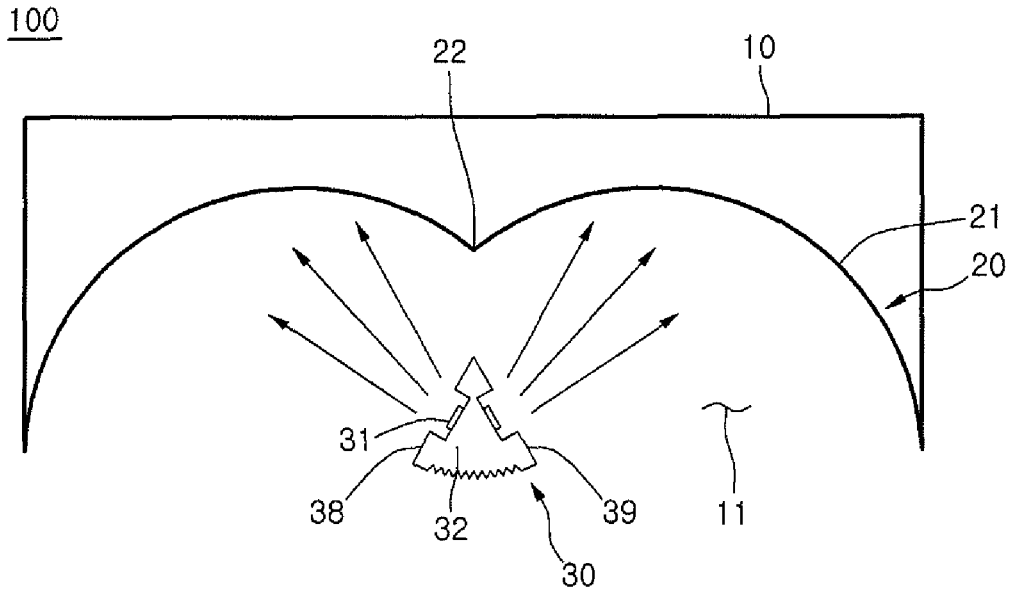
FIG. 1 is a cross-sectional view illustrating a lighting device according to an embodiment of the present invention.
Figure 2:
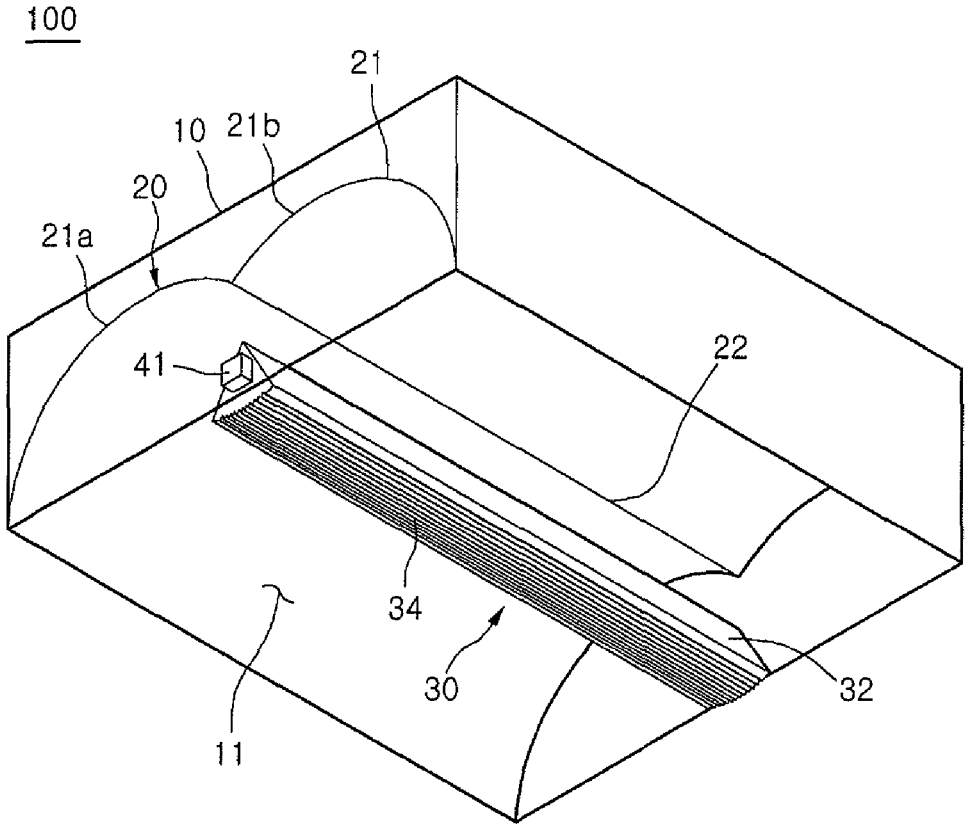
FIG. 2 is a perspective view illustrating the lighting device of FIG. 1.

FIGS. 1 and 2 illustrate a lighting device 100 according to an embodiment of the present invention. As shown, the lighting device 100 includes a housing 10, a reflector 20 and a light source unit 30. Further, in the embodiment shown in FIGS. 1 and 2, the housing 10 has a box shape to receive the reflector 20 and an opening 11 through which a reflecting surface 21 of the reflector 20 is exposed and light is emitted. The housing 10 can also have shapes other than the box shape shown in FIGS. 1 and 2.

In addition, the reflector 20 is disposed within the housing 10 and has a reflecting surface 21 that reflects light emitted from the light source unit 30. In the example shown in FIGS. 1 and 2, the reflecting surface 21 includes parabola-shaped reflecting surfaces 21*a* and 21*b*. However, the reflecting surface 21 can have other shapes based on the structure of the lighting device 100. In addition, as shown in FIGS. 1 and 2, the parabola-shaped reflecting surfaces 21*a* and 21*b* intersect to form a boundary 22 that is disposed in a longitudinal direction of the lighting device 100 and that vertically overlaps the light source unit 30. Also, the material and color of the reflector 20 can be varied to achieve a specific illumination of the lighting device 100. For example, the reflector 20 can be formed of a white material having a high reflecting efficiency or be coated with silver (Ag) or aluminum (Al).

Figure 4:
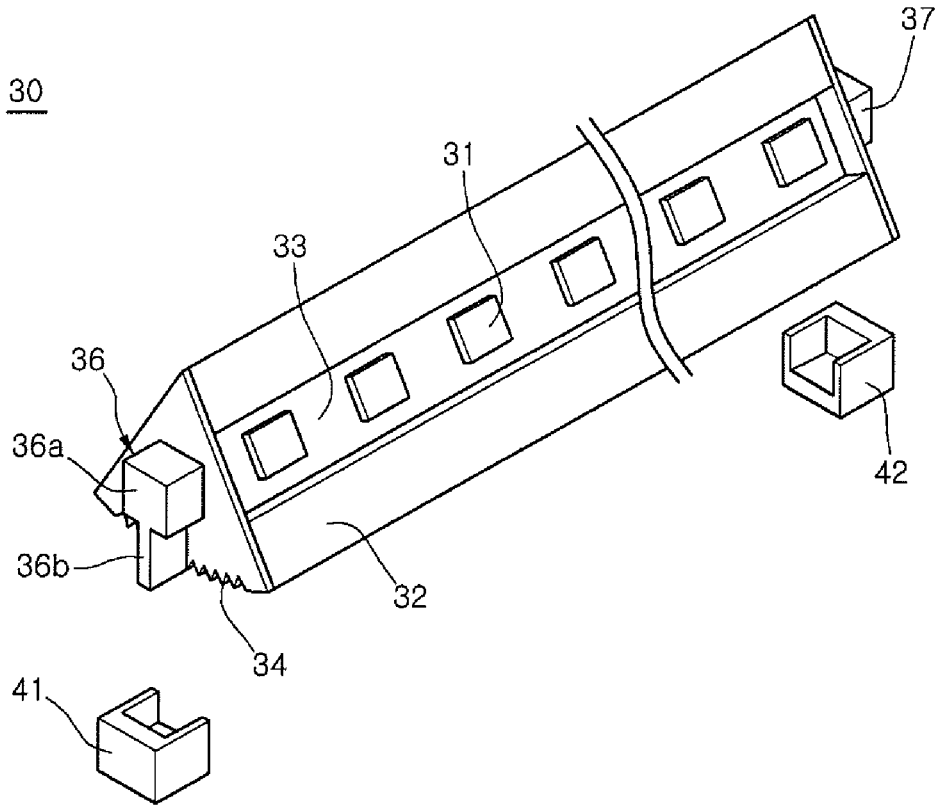
FIG. 4 is a schematic view illustrating the light source unit of FIG. 1 being removed from first and second socket parts.
Figure 5:
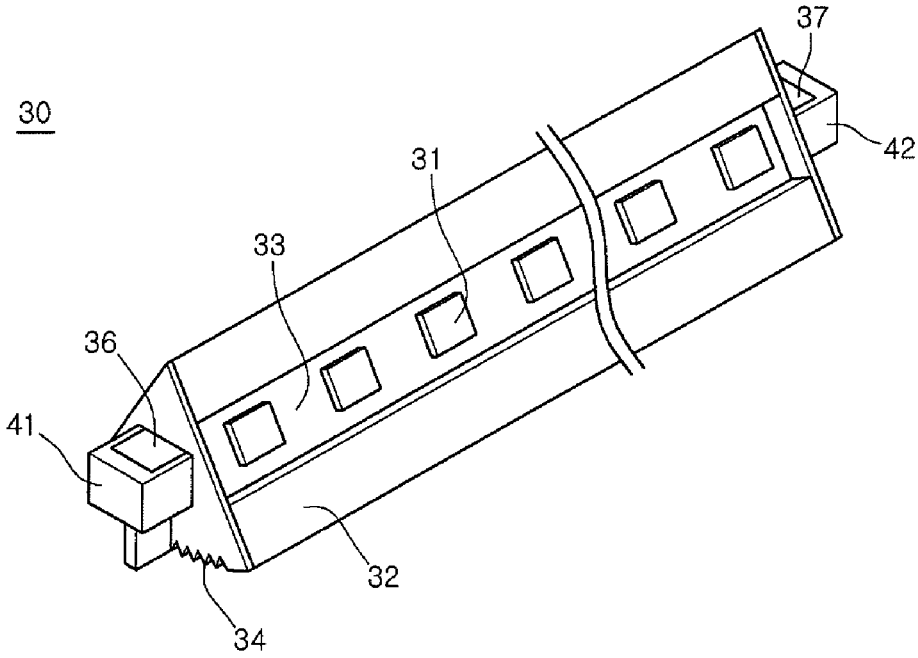
FIG. 5 is a schematic view illustrating the first and second socket parts of FIG. 4 being coupled with the light source unit of FIG. 1.

Further, according to an embodiment of the present invention, the light source unit 30 can be held and placed within the housing 10 via socket parts that interact and connect with terminals of the light source unit 30. FIG. 2 illustrates a single socket part 42 (another socket part on the opposite side of the light source 30 is not shown in FIG. 2). However, FIGS. 4-7 illustrate the socket parts and connection terminals in more detail. For Example, FIG. 4 illustrates sockets parts 41 and 42 and connection terminals 36 and 37 in an exploded view. FIG. 5 illustrates the socket parts and connection terminals being connected together. As discussed above, the socket parts 41 and 42 are connected to inner surfaces of the housing 10 according to one embodiment of the present invention.

In more detail, and as shown in FIG. 4, both ends of the light source unit 30 include the first and second connection terminals 36 and 37 that interact and couple with the first and second socket parts 41 and 42 disposed on the inner surfaces of the housing 10. Thus, the first and second connection terminals 36 and 37 coupled to the first and second socket parts 41 and 42 support and fix the light source unit 30. In addition, the first and second connection terminals 36 and 37 respectively receive power from the first and second socket parts 41 and 42 so as to provide power to the light source 30.

Thus, in this embodiment, the first and second socket parts 41 and 42 coupled to the first and second connection terminals 36 and 37 can be referred to as first and second coupling parts. In addition, at least one of the first and second coupling parts can include a control part that receives a driving signal to control and drive the light source unit 30. That is, the control part controls light emitting diodes 31 of the light source 30 to selectively emit light having a desired color, and adjusts the brightness and colors of the light emitting diodes 31. As such, the control part controls the light emitting diodes 31 installed on the light source unit 30 to provide various illuminations. Also, when the light source unit 30 reaches its service life or is broken, the light source unit 30 can be easily replaced by removing the first and second connection terminals 36 and 37 from the first and second socket parts 41 and 42.

Figure 6:
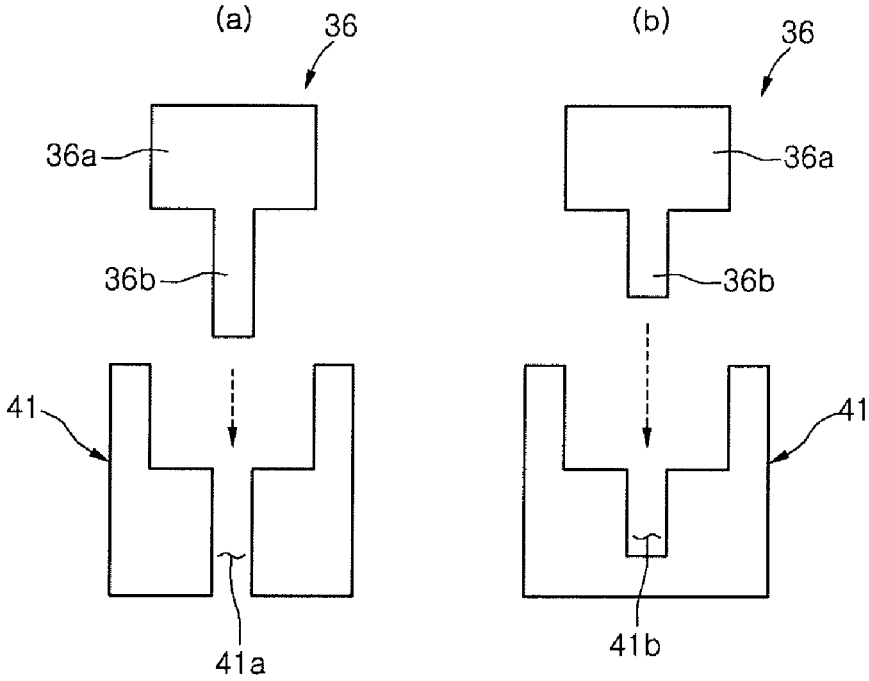
FIG. 6 is a schematic view illustrating coupling mechanisms of a first connection terminal and the first socket part in the lighting device of FIG. 1.
Figure 7:
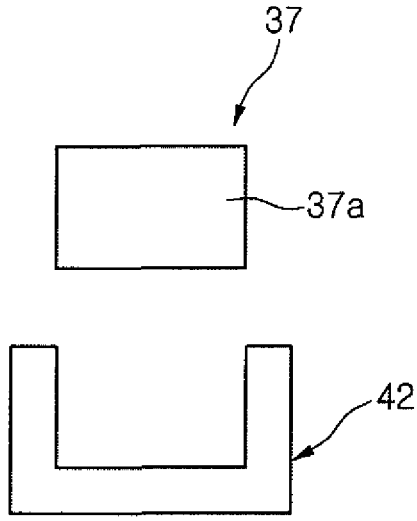
FIG. 7 is a schematic view illustrating a coupling mechanism of a second connection terminal and the second socket part in the lighting device of FIG. 1.

Next, FIGS. 6 and 7 illustrate the above-described coupling mechanisms. In more detail, and as shown in FIGS. 6 and 7, a shape of the first connection terminal 36 can be different from the shape of the second connection terminal 37, and the shape of the first socket part 41 can be different from the shape of the second socket part 42. Thus, the light source unit 30 can be accurately coupled to the first and second socket parts 41 and 42 without mismatching. For example, as shown in the embodiment of FIG. 6, the first connection terminal 36 includes a block portion 36*a* and a protrusion portion 36*b* protruding to the lower side of the block portion 36*a*, and the block portion 36*a* is integrally formed with the protrusion portion 36*b*. In addition, the first socket part 41 has a shape corresponding to the first connection terminal 36, and the protrusion portion 36*b* is inserted into an insertion portion disposed in the first socket part 41.

In addition, as shown in FIG. 6(*a*), a through hole 41*a* is disposed in the insertion portion, and the protrusion portion 36*b* passes through the through hole 41*a*. Alternatively, and as shown in FIG. 6(*b*), the insertion portion is provided with an insertion recess 41*b*, and the protrusion portion 36*b* is disposed in the insertion recess 41*b*. Referring to FIG. 7, the second connection terminal 37 can also include only a block portion 37*a*, and the second socket part 42 can have a shape corresponding to the second connection terminal 37. Thus, the second connection terminal 37 can be inserted and coupled to the second socket part 42. However, the shapes of the first and second connection terminals 36 and 37 and the first and second socket part 41 and 42 are not limited to the shapes shown in these figures.

For example, the shape of the cross section of the block portion 36*a* and 37*a* of the first and second connection terminals 36 and 37 can have a circular, oval and polygonal shape. Also, the shape of the protrusion portion 36*b* can have a circular, oval and polygonal shape. Moreover, the first and second connection terminals 36 and 37 can have the same shape, and both the first and second connection terminals 36 and 37 can include the block portion and the protrusion portion, or only include the block portion. Moreover, the first and second connection terminals 36 and 37 can include at least two pins, respectively, and the first and second socket parts 41 and 42 can have insertion openings into which the at least two pins are inserted. Thus, the first and second socket parts 41 and 42 support and fix the light source unit 30 and supply power to the light source unit 30.

Next, a more detailed description of the light source 30 will be given with respect to FIGS. 1-5. In particular, as shown in FIGS. 1 and 2, the light source unit 30 is disposed in the middle of the opening 11 of the housing 10 in a longitudinal direction with respect to the reflector 20. For example, the light source unit 30 can be disposed in the opening 11 of the housing 10 along the boundary 22 of the reflector 20. Further, as discussed above, the light source unit 30 is supported and fixed by the first and second socket parts 41 and 42 disposed on the inner surfaces of the housing 10.

In addition, as shown in FIG. 2, the light source unit 30 extends in the longitudinal direction of the reflector 20. Further, as shown in the different views of FIGS. 1-5, the light source 30 includes a body 32 having one or more inclined surfaces, light emitting recesses 33 provided to the inclined surfaces, light emitting diodes (LEDs) 31 installed on the light emitting recesses 33, and the first and second connection terminals 36 and 37 disposed at both ends of the body 32. Further, the LEDs are semiconductor devices that convert electrical energy to light.

The body 32 may be formed of a material adapted to efficiently emit heat such as aluminum (Al), stannum (Sn), nickel (Ni), silver (Ag), copper (Cu), titanium (Ti), molybdenum (Mo), tungsten (W), gold (Au), and platinum (Pt). Alternatively, the body 32 may be formed of resin. In addition, the body 32 may be formed of a white material having a high reflecting efficiency or be coated with silver (Ag) or aluminum (Al). Thus, the recesses formed in the body efficiently emit light from the LEDS toward the reflector. The body 32 may also have a polygonal cross section, and as shown in FIG. 2, extend in the longitudinal direction of the reflector 20. Although the body 32 has a fan-shaped cross section in FIGS. 1 to 5, the shape of the cross section is not limited to this particular shape.

Figure 3:
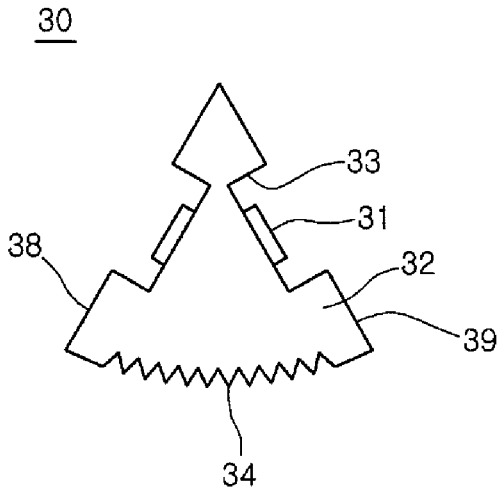
FIG. 3 is a cross-sectional view illustrating a light source unit of the lighting device of FIG. 1.

Also, as shown in FIGS. 1 and 3, both side surfaces of the body 32 include inclined surfaces such as first and second inclined surfaces 38 and 39 toward the reflecting surface 21 of the reflector 20. That is, both the side surfaces of the body 32 include the first and second inclined surfaces 38 and 39 that face the parabola-shaped reflecting surfaces 21*a* and 21*b* of the reflecting surface 21, respectively (see also FIG. 2). The side surfaces of the body 32 may be provided with one or more inclined surfaces and are not limited to the first and second inclined surfaces 38 and 39.

Further, as shown in FIGS. 4 and 5, the first and second inclined surfaces 38 and 39 include light emitting recesses 33 extending in the longitudinal direction of the reflector 20. The depths and widths of the light emitting recesses 33 can be varied according to light distribution of the light emitting diodes 31 installed on the light emitting recesses 33. The depths and widths of the light emitting recesses 33 may also be adjusted to prevent light from being emitted directly to the outside through the opening 11 from the light emitting diodes 31 so that light reflected by the reflecting surface 21 is emitted to the outside through the opening 11.

In addition, as shown in FIGS. 4 and 5, the light emitting diodes 31 are installed in the light emitting recesses 33. In more detail, the light emitting diodes 31 may be arrayed in the light emitting recesses 33, and the number and arrangement of the light emitting diodes 31 are not limited. The light emitting diodes 31 may also be selected among light emitting diodes which emit red, blue, green or white light. Other colors may also be used. Thus, according to an embodiment of the present invention, light emitted from the light emitting diodes 31 is directed to the reflecting surface 21 of the reflector 20, that is, to the parabola-shaped reflecting surfaces 21*a* and 21*b*. Thus, the light emitted from the light emitting diodes 31 is reflected to a user through the reflector 20 instead of being transmitted directly to the user. Accordingly, the glare from the light is reduced and soft light is provided to the user.

In addition, a substrate (not shown) is disposed in the light emitting recesses 33, and the light emitting diodes 31 are installed on the substrate to electrically connect the light emitting diodes 31. Alternatively, a plurality of electrodes can be disposed in the light emitting recesses 33 so that the light emitting diodes 31 are electrically connected through the electrodes. Further, a lens can be disposed at the light emitting recesses 33 to control the distribution of light emitted from the light emitting diodes 31. Alternatively, the light emitting recesses 33 can be filled with resin to control light distribution. A fluorescent member may also be added to the lens or the resin. Also, as shown in the embodiment in FIGS. 2-5, a lower surface of the body 32 includes a convex-concave portion 34 that increases the surface area of the light source unit 30 to efficiently emit heat. The convex-concave portion 34 also extends in the longitudinal direction of the light source unit 30 in this embodiment.

Figure 8:
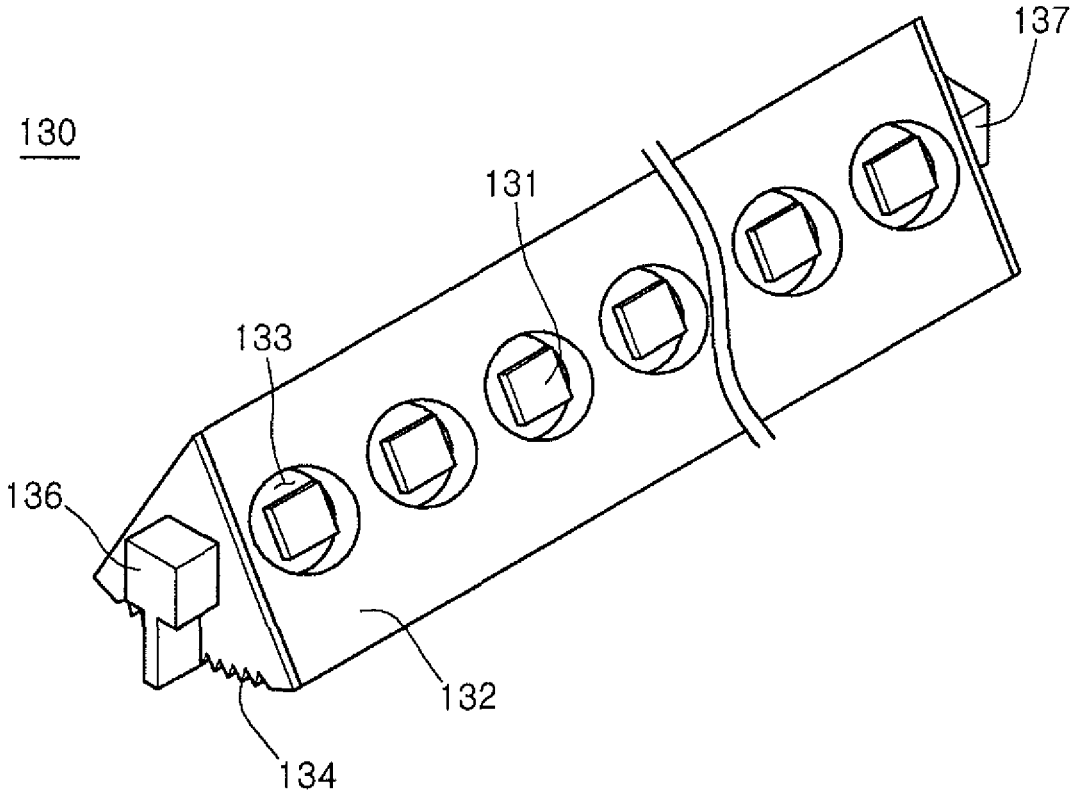
FIG. 8 is a perspective view illustrating a light source unit of a lighting device according to another embodiment of the present invention.

Next, FIG. 8 illustrates a perspective view of a light source unit 130 included in a lighting device according to another embodiment of the present invention. As shown, the light source unit 130 extends in the longitudinal direction of a reflector, and includes a body 132 having first and second inclined surfaces, light emitting recesses 133 provided to the first and second inclined surfaces, light emitting diodes 131 installed on the light emitting recesses 133, and first and second connection terminals 136 and 137 disposed at both ends of the body 132.

Further, the light emitting recesses 133 are disposed partially in both side surfaces of the body 132 only at positions where the light emitting diodes 131 are installed. That is, the light emitting recesses 133 are spaced apart from each other in the body 132. The upper portion of the light emitting recesses 133 can also have various shapes including circular, oval and polygonal shapes in a plan view. The light emitting diodes 131 are also arrayed in the light emitting recesses 133.

Figure 9:
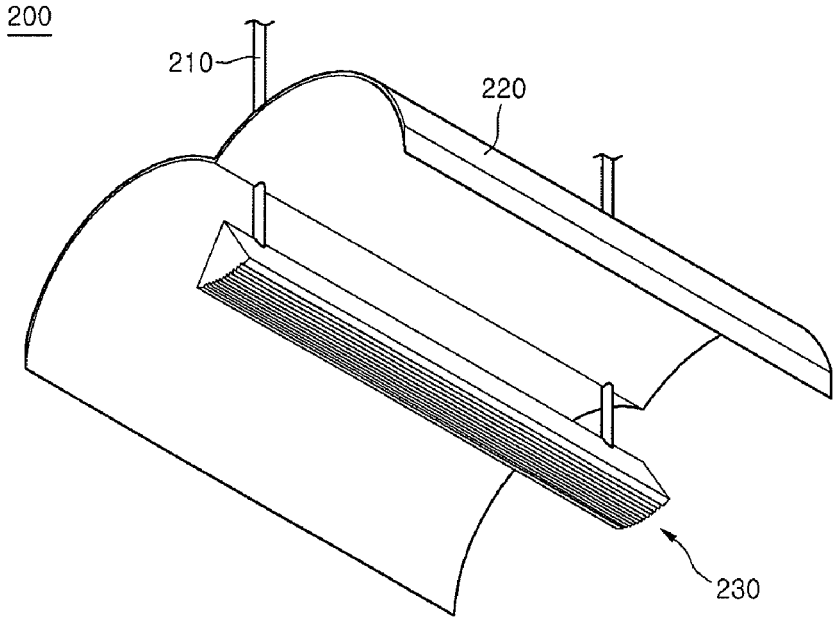
FIG. 9 is a perspective view illustrating a lighting device according to still another embodiment of the present invention.

Next, FIG. 9 is a perspective view illustrating a lighting device 200 according to another embodiment of the present invention. As shown, the lighting device 200 includes a light source unit 230, a reflector 220 and support units 210. The support units 210 have bar shapes, support the reflector 220 and the light source unit 230, and supply power to the light source unit 230. Further, the support units 210 extend from an external support member such as a ceiling disposed above the reflector 220 and receive power from an external power source such as a power supply unit (PSU) installed at the external support member.

In addition, a first end of the support unit 210 is connected to the external power source, and a second end passes through the reflector 220 and connects to an upper surface of the light source unit 230. The second end of the support unit 210 can also be adhered through adhesive or coupled through a screw member to the upper surface of the light source unit 230. A wire member can also be disposed in the support unit 210 so that electric current can flow through the wire member. Accordingly, power can be supplied to the light source unit 230 through the support unit 210.

Also, the upper surface of the light source unit 230 can include a connection terminal for connecting to the support unit 210. The light source unit 230 can then receive power from the support unit 210 through the connection terminal. Further, the support unit 210 passes through the reflector 220 and supports and fixes the reflector 220. In more detail, the support unit 210 passing through the reflector 220 can be firmly coupled to the reflector 220 through an adhesive, for example. Alternatively, a separate support member can be connected to the reflector 220 and support the reflector 220. Other connection or coupling mechanisms can also be used. Further, although FIG. 9 illustrates two support units 210, a single support unit or more than two support units can be provided. Furthermore, the shape of the support unit 210 can be varied.

Figure 10:
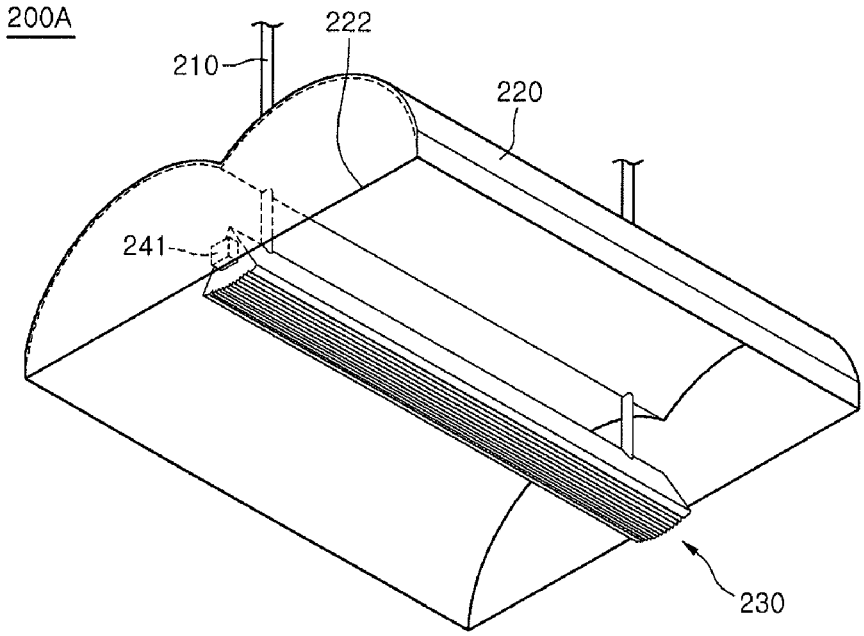
FIG. 10 is a perspective view illustrating a lighting device according to another embodiment of the present invention.

Next, FIG. 10 is a perspective view illustrating a lighting device 200A according to another embodiment of the present invention. Referring to FIG. 10, the lighting device 200A includes the light source unit 230, the reflector 220 and the support units 210 (the same as that shown in FIG. 9). However, in this embodiment, the reflector 220 has a housing structure with an opening. Also, as shown in FIG. 10, inner surfaces 222 of the reflector 220 include socket parts 241 that supply power to the light source unit 230 and support the light source unit 230. Also, because the coupling relationship between the socket parts 241 and connection terminals of the light source unit 230, and the functions thereof are the same as those of the embodiment of FIG. 1, a detailed description is omitted.

In addition, similar to the description above with respect to FIG. 9, the support units 210 having the bar shapes support the reflector 220 and the light source unit 230. The support units 210 also extend from an external support member such as a ceiling disposed above the reflector 220, receive power from an external power source such as a PSU installed at the external support member, and supply power to the socket parts 241 of the reflector 220. In addition, a first end of the support unit 210 is connected to the external power source, and a second end passes through the reflector 220 and connects to an upper surface of the light source unit 230. The second end of the support unit 210 can also be adhered through adhesive or coupled through a screw member to the upper surface of the light source unit 230. A wire member can also be disposed in the support unit 210 so that electric current can flow through the wire member. Accordingly, power can be supplied to the light source unit 230 through the support unit 210.

Also, the upper surface of the light source unit 230 can also include a connection terminal for connecting to the support unit 210. The light source unit 230 can then receive power from the support unit 210 through the connection terminal. Further, the support unit 210 passes through the reflector 220 and supports and fixes the reflector 220. In more detail, the support unit 210 passing through the reflector 220 can be firmly coupled to the reflector 220 through an adhesive, for example. Alternatively, a separate support member can be connected to the reflector 220 and support the reflector 220. Other connection or coupling mechanisms can also be used. Further, although FIG. 10 illustrates two support units 210, a single support unit or a plurality of support units can be provided. Furthermore, the shape of the support unit 210 can be varied.

Figure 11:
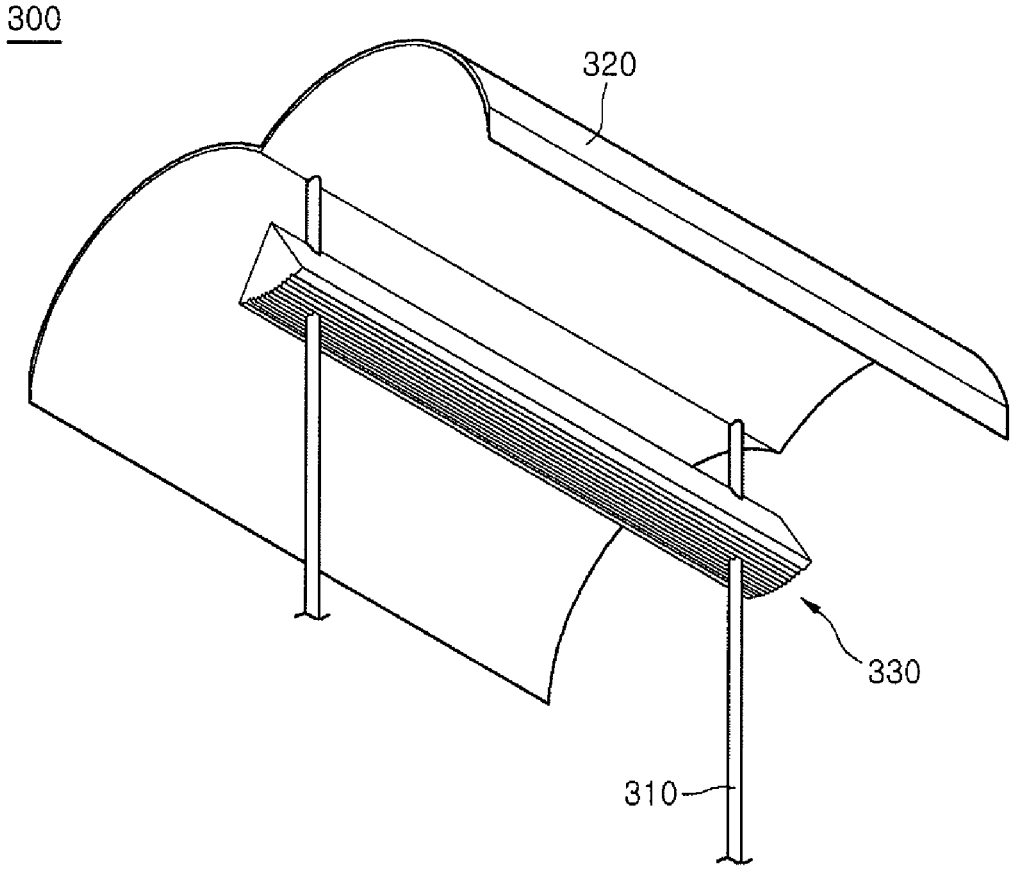
FIG. 11 is a perspective view illustrating a lighting device according to yet another embodiment of the present invention.

Next, FIG. 11 is a perspective view illustrating a lighting device 300 according to yet another embodiment of the present invention. As shown, the lighting device 300 includes a light source unit 330, a reflector 320 and support units 310. The support units 310 have bar shapes, are coupled to the reflector 320 and the light source unit 330, and support the reflector 320 and the light source unit 330. In addition, power is supplied to the light source unit 330 through the support units 310. The support units 310 extend from an external support member such as a bottom surface disposed under the light source unit 330, and receive power from an external power source such as PSU installed at the external support member.

A first end of the support unit 310 is also connected to the external power source, and a second end is connected to a portion of a reflecting surface of the reflector 320. The second end of the support unit 310 can also be adhered through adhesive, or coupled through a screw member to the reflector 320. The support units 310 can also be connected to the reflector 320 passing through the light source unit 330. Further, the support unit 310 passing through the light source unit 330 can be firmly coupled to the light source unit 330. A wire member can also be disposed in the support unit 310 so that an electric current can flow through the wire member. Accordingly, power can be supplied to the light source unit 330 through the wire member. Further, although FIG. 11 illustrates two support units 210, a single support unit or a plurality of support units can be provided. Furthermore, the shape of the support unit 210 can be varied.

Figure 12:
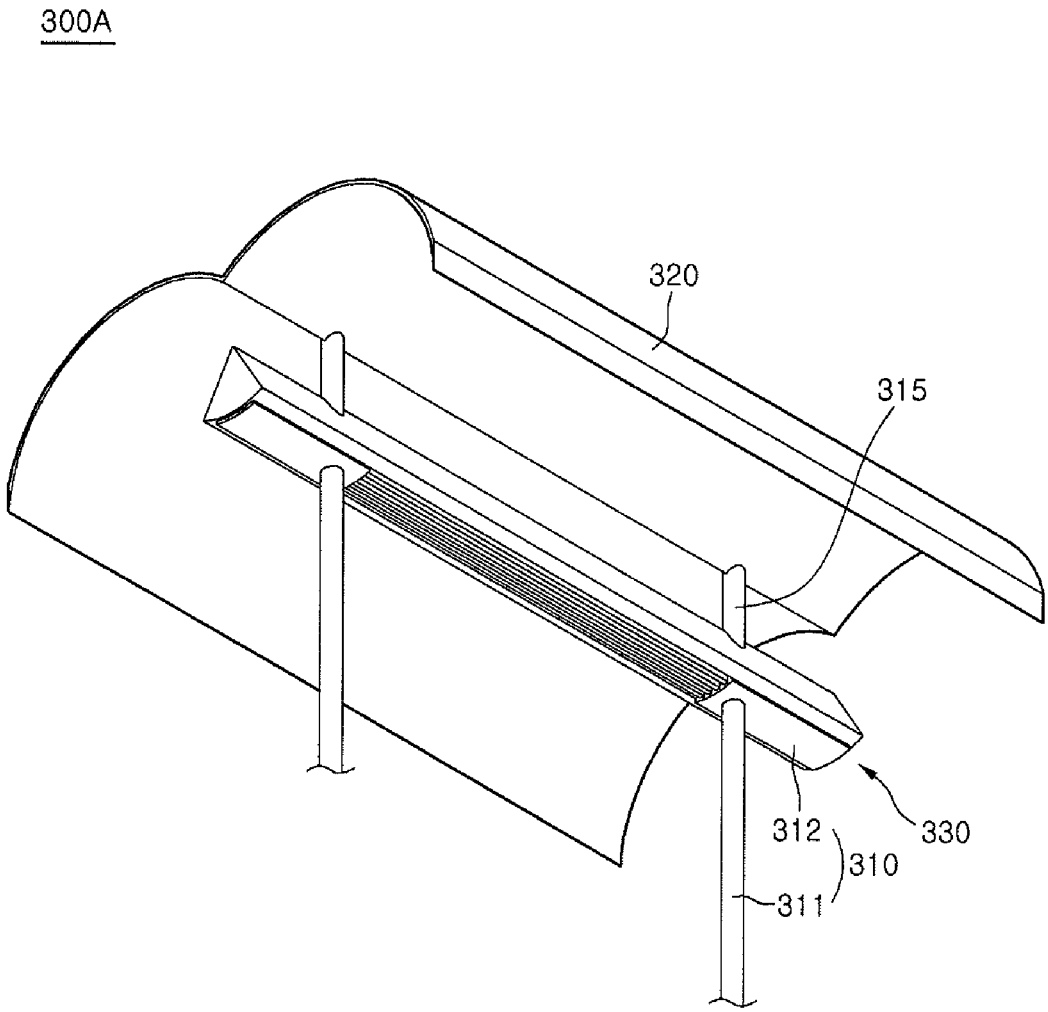
FIG. 12 is a perspective view illustrating a lighting device according to another embodiment of the present invention.

FIG. 12 is a perspective view illustrating a lighting device 300A according to another embodiment of the present invention. As shown, the lighting device 300A includes the light source unit 330, the reflector 320 and support units 310 and 315. The support unit 310 will be referred to as a first support unit and the support unit 315 will be referred to as a second support unit. As shown in FIG. 12, the first support unit 310 includes a coupling part 312 coupled to a lower surface of the light source unit 330, and a bar part 311 extending from an external support member under the light source unit 330 to supply power to the light source unit 330. The second support unit 315 also extends from an upper surface of the light source unit 330 to support the reflector 320.

Figure 13:
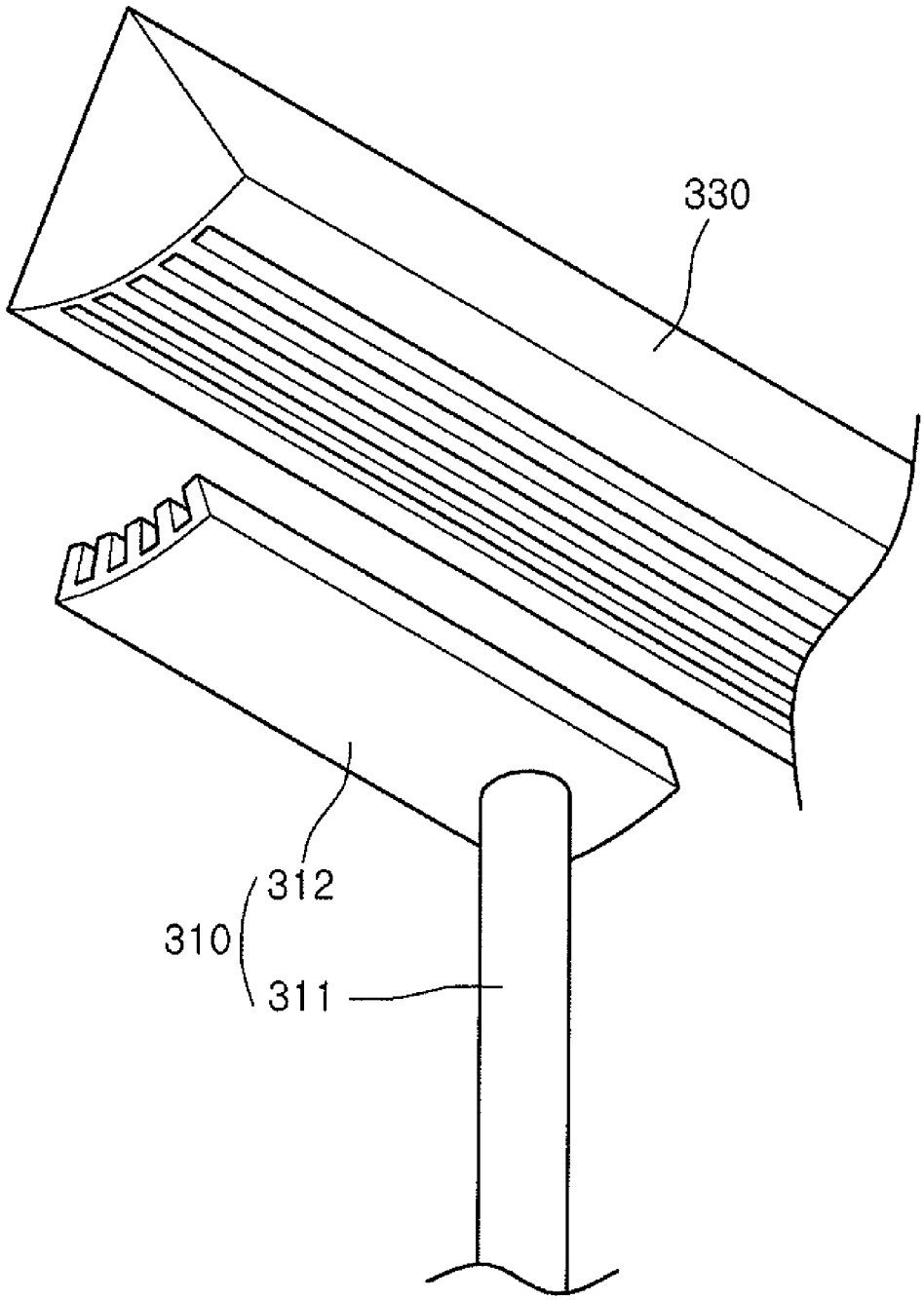
FIG. 13 is a schematic view illustrating the coupling relationship between a light source unit of a lighting device and a first support unit according to an embodiment of the present invention.

Next, FIG. 13 is a schematic view illustrating the coupling relationship between the light source unit 330 and the first support unit 310 shown in FIG. 12. Referring to FIGS. 12 and 13, the bar part 311 of the first support unit 310 has a bar shape, and the coupling part 312 has a shape corresponding to a convex-concave portion disposed at the lower surface of the light source unit 330 so that the coupling part 312 can be firmly coupled to the light source unit 330. The coupling part 312 of the first support unit 310 can also be used to transmit power to the light source unit 330.

In addition, the bar part 311 of the first support unit 310 extends from an external support member such as a bottom surface disposed under the light source unit 330. The bar part 311 can also be used to receive power from an external power source such as a PSU installed at the external support member, and transmit the power to the light source unit 330. A wire member can also be disposed in the support unit 310 so that an electric current can flow through the wire member. Accordingly, power can be supplied to the light source unit 330 through the wire member. Further, the second support unit 315 extends from the upper surface of the light source unit 330 to support and fix the reflector 320. Also, a single support unit or more than two support units can be used. The shape of the support unit can also be varied.

Figure 14:
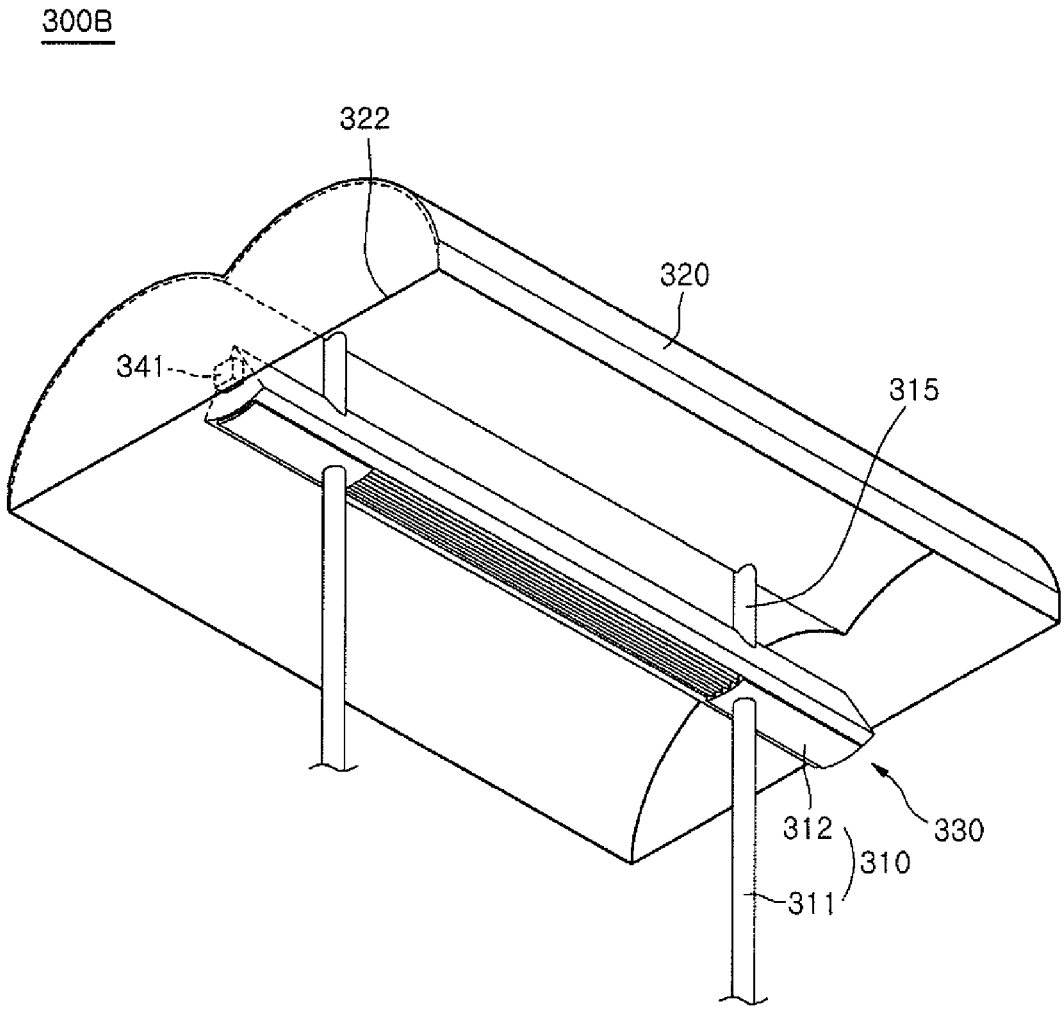
FIG. 14 is a perspective view illustrating a lighting device according to another embodiment of the present invention.

Next, FIG. 14 is a perspective view illustrating a lighting device 300B according to still another embodiment of the present invention. As shown, the lighting device 300B includes the light source unit 330, the reflector 320, the first support unit 310 and the second support unit 315 similar to the embodiment shown in FIG. 12. In addition, the first support unit 310 includes the coupling part 312 coupled to the lower surface of the light source unit 330, and the bar part 311 extending from an external support member under the light source unit 330 to supply power to the light source unit 330.

The second support unit 315 also extends from the upper surface of the light source unit 330 to support the reflector 320. Further, the reflector 320 is a housing structure with an opening. Inner surfaces 322 of the reflector 320 also include the socket parts 341 that transmit power to the light source unit 330 and support the light source unit 330. Also, because the coupling relationship between the socket parts 341 and connection terminals of the light source unit 330, and the functions thereof are the same as those of the embodiment of FIG. 1, a description of these parts is omitted. The other components have already been discussed with respect to FIG. 13. Note also that the reflector 320 in FIG. 14 does not have a box shape on an upper surface as the reflector 20 in FIG. 2.

Thus, the present invention provides several advantages. For example, the light source including the LEDs according to embodiments of the present invention have many advantages over fluorescent and incandescent light sources such as a lower power consumption, a long service life, a rapid response speed, a stable light source and environmentally-friendly properties. The lighting device of embodiments of the present invention can also be easily disassembled and repaired, if needed.

In addition, any reference in this specification to "one embodiment," "an embodiment," "example embodiment," etc., means that a particular feature, structure or characteristic described in connection with the embodiment is included in at least one embodiment of the invention. The appearances of such phrases in various places in the specification are not necessarily all referring to the same embodiment. Further, when a particular feature, structure or characteristic is described in connection with any embodiment, it is submitted that it is within the purview of one skilled in the art to affect such feature, structure or characteristic in connection with other ones of the embodiments.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

What is claimed is:

1. A lighting device, comprising:

a reflector including a reflecting surface; and a light source unit disposed under the reflector and configured to emit light towards the reflector, wherein the light source unit includes:

a main body disposed longitudinally along the reflector and having first and second outside surfaces that are inclined towards the reflecting surface; and a plurality of first light emitting diodes disposed on the first outside surface and a plurality of second light emitting diodes disposed on the second outside surface and configured to emit the light towards the reflector, wherein the reflector comprises two parabola shaped reflectors joined together at a middle portion of the reflector, wherein the main body of the light source unit is disposed at a position corresponding to the middle portion of the reflector, and wherein the reflector further includes two inner housing surfaces at ends of the two parabola-shaped reflecting surfaces so as to form a reflecting housing, first and second connection terminals provided at first and second ends of the light source unit; and first and second socket parts disposed on the two inner surfaces of the reflector and configured to be respectively coupled to the first and second connection terminals to support and fix the light source unit and supply power to the light source unit.

2. The lighting device of claim 1, further comprising:

first and second light emitting recesses respectively disposed within the first and second outside surfaces of the main body of the light source, wherein the plurality of first light emitting diodes are disposed within the first light emitting recess and the plurality of second light emitting diodes are disposed within the second light emitting recess.

3. The lighting device of claim 1, wherein the main body comprises a substantially triangular shape and the first and second outside surfaces are adjacent sides of the triangular shape.

4. The lighting device of claim 1, wherein the main body includes a convex-concave portion on a lower surface of the main body connecting the first and second outside surfaces and facing downwards away from the first and second outside surfaces.

5. The lighting device of claim 2, wherein the first and second light emitting recesses extend in a longitudinal direction along the main body of the light source unit.

6. The lighting device of claim 2, wherein the first and second light emitting recesses respectively disposed within the first and second outside surfaces include a plurality of recesses spaced apart from each other, and wherein the plurality of recesses spaced apart from each other include at least one light emitting diode.

7. The lighting device of claim 2, further comprising:

at least one of a lens disposed at the first and second light emitting recesses and a resin filled in the first and second light emitting recesses configured to control a distribution of light emitted from the light emitting diodes.

8. The lighting device of claim 1, wherein an upper surface of the reflector has a box-shape.

9. The lighting device of claim 1, wherein an upper surface of the reflector is defined by the two-parabola-shaped reflecting surfaces.

10. The lighting device of claim 1, further comprising:

a control part disposed within at least one of the first and second connection terminals and first and second socket parts and configured to receive a driving signal to control and drive the light source unit.

11. The lighting device of claim 1, wherein the first connection terminal has a different shape than the second connection terminal, and the first socket part has a different shape than the second socket part.

12. The lighting device of claim 1, wherein the first connection terminal has a same shape as the second connection terminal, and the first socket part has a same shape as the second socket part.

13. The lighting device of claim 1, further comprising:

a support unit configured to support the reflector and the light source unit.

14. The lighting device of claim 13, wherein the support unit has a first end passing through the reflector and connecting to an upper surface of the main body of the light source unit, and has a second end configured to be connected to an external support member disposed above the reflector.

15. A lighting device, comprising:

a reflector including a reflecting surface; and a light source unit disposed under the reflector and configured to emit light towards the reflector, wherein the light source unit includes:

a main body disposed longitudinally along the reflector and having first and second outside surfaces that are inclined towards the reflecting surface;

a plurality of first light emitting diodes disposed on the first outside surface and a plurality of second light emitting diodes disposed on the second outside surface and configured to emit the light towards the reflector; and a support unit configured to support the reflector and the light source unit, and wherein the support unit has a first end passing through the main body of the light source and connecting to an inner surface of the reflector, and has a second end configured to be connected to an external support member disposed below the light source unit.

16. A lighting device, comprising:

a reflector including a reflecting surface; and a light source unit disposed under the reflector and configured to emit light towards the reflector, wherein the light source unit includes:

a main body disposed longitudinally along the reflector and having first and second outside surfaces that are inclined towards the reflecting surface;

a plurality of first light emitting diodes disposed on the first outside surface and a plurality of second light emitting diodes disposed on the second outside surface and configured to emit the light towards the reflector; and a support unit configured to support the reflector and the light source unit, and wherein the support unit includes a first support unit extending from a position below the main body of the light source unit and configured to engage with a lower surface of the main body of the light source unit, and a second support unit configured to extend from a top surface of the main body of the light source unit to the reflector.

17. The lighting device of claim 16, wherein the first support unit includes a coupling part configured to couple the first support unit to the main body of the light source unit.

18. The lighting device of claim 16, wherein the coupling part includes a convex-concave portion configured to engage with the convex-concave portion of the lower surface of the main body of the light source unit.

19. The lighting device of claim 13, wherein the support unit includes at least two bar-shaped support units.

* * * * *

UNITED STATES PATENT AND TRADEMARK OFFICE

CERTIFICATE OF CORRECTION

PATENT NO. : 8,376,578 B2
APPLICATION NO. : 12/652691
DATED : February 19, 2013
INVENTOR(S) : Kyung Il Kong et al.

It is certified that error appears in the above-identified patent and that said Letters Patent is hereby corrected as shown below:

ON THE TITLE PAGE:

Item (30), correct the Foreign Application Priority Data to read as follows:

--Jun. 29, 2009 (KR) ..... 10-2009-0058160
Jun. 29, 2009 (KR) ..... 10-2009-0058161
Jun. 29, 2009 (KR) ..... 10-2009-0058162--.

Signed and Sealed this
Twenty-first Day of May, 2013

Teresa Stanek Rea
*Acting Director of the United States Patent and Trademark Office*